US010994534B2

(12) United States Patent
Zhou et al.

(10) Patent No.: US 10,994,534 B2
(45) Date of Patent: May 4, 2021

(54) HIGH-FREQUENCY MULTI-PULSE INKJET

(71) Applicant: BOARD OF TRUSTEES OF THE UNIVERSITY OF ARKANSAS, Fayetteville, AR (US)

(72) Inventors: Wenchao Zhou, Springdale, AR (US); Chao Sui, Fayetteville, AR (US)

(73) Assignee: Board Of Trustees Of The University Of Arkansas, Fayetteville, AR (US)

( * ) Notice: Subject to any disclaimer, the term of this patent is extended or adjusted under 35 U.S.C. 154(b) by 0 days.

(21) Appl. No.: 16/398,171

(22) Filed: Apr. 29, 2019

(65) Prior Publication Data

US 2019/0389209 A1 Dec. 26, 2019

Related U.S. Application Data

(60) Provisional application No. 62/663,710, filed on Apr. 27, 2018.

(51) Int. Cl.
*B41J 2/045* (2006.01)

(52) U.S. Cl.
CPC ..... *B41J 2/04588* (2013.01); *B41J 2/04581* (2013.01)

(58) Field of Classification Search
CPC ..... B41J 2/04588; B41J 2/04581; B41J 2/04573; B41J 2/04591; B41J 2/04595
USPC ..... 347/9–11, 68, 70, 71, 72
See application file for complete search history.

(56) References Cited

U.S. PATENT DOCUMENTS

| | | | | |
|---|---|---|---|---|
| 2,600,129 | A | 6/1952 | Richards | |
| 3,828,357 | A | 8/1974 | Koeblitz | |
| 5,610,637 | A * | 3/1997 | Sekiya | B41J 2/04551 347/10 |
| 6,029,896 | A | 2/2000 | Self et al. | |
| 6,063,339 | A * | 5/2000 | Tisone | B01J 19/0046 422/509 |
| 7,988,247 | B2 * | 8/2011 | Letendre | B41J 2/04573 347/10 |
| 8,393,702 | B2 * | 3/2013 | Menzel | B41J 2/04516 347/11 |
| 2012/0306954 | A1 * | 12/2012 | Nishikawa | B41J 2/04516 347/11 |

OTHER PUBLICATIONS

U. Chen and O. A. Basaran, "A new method for significantly reducing drop radius without reducing nozzle radius in drop-on-demand drop production," *Phys. Fluids*, vol. 14, (1), pp. L1-L4, 2002.

(Continued)

*Primary Examiner* — An H Do
(74) *Attorney, Agent, or Firm* — Keith A. Vogt; Keith Vogt Ltd.

(57) ABSTRACT

A printing system and method for forming an ink droplet through the use of a multi-pulse driving signal to increase the printing frequency without reducing the droplet size by applying a multi-pulse driving signal to a small nozzle and to increase the inkjet printing speed by using a smaller nozzle to produce the same-size droplet using a multi-pulse driving signal, which allow for higher printing frequency due to the smaller nozzle size as dictated by the fundamental droplet formation dynamics.

19 Claims, 6 Drawing Sheets

(56) References Cited

OTHER PUBLICATIONS

J. Meacham et al, "Droplet formation and ejection from a micromachined ultrasonic droplet generator: Visualization and scaling," *Phys. Fluids*, vol. 17, (10), pp. 100605, 2005.
H. Wijshoff, "The dynamics of the piezo inkjet printhead operation," *Physics Reports*, vol. 491, (4), pp. 77-177, 2010.
J. C. Yang et al, "A simple piezoelectric droplet generator," *Exp. Fluids*, vol. 23, (5), pp. 445-447, 1997.
P. Chen et al, "Pressure response and droplet ejection of a piezoelectric inkjet printhead," *Int. J. Mech. Sci.*, vol. 41, (2), pp. 235-248, 1999.
H. Gan et al, "Reduction of droplet volume by controlling actuating waveforms in inkjet printing for micro-pattern formation," *J Micromech Microengineering*, vol. 19, (5), pp. 055010, 2009.
T. Liou, C. Chan and K. Shih, "Effects of actuating waveform, ink property, and nozzle size on piezoelectrically driven inkjet droplets," *Microfluidics and Nanofluidics*, vol. 8, (5), pp. 575-586, 2010.
N. Reis, C. Ainsley and B. Derby, "Ink-jet delivery of particle suspensions by piezoelectric droplet ejectors," *J. Appl. Phys.*, vol. 97, (9), pp. 094903, 2005.
Womac et al, "Influence of Pulse Signal Spike and Liquid Characteristics on Performance of Uniform-Droplet Generator," *Trans. ASAE*, vol. 35, (1), pp. 71-79, 1992.
H. Wu et al, "Study of micro-droplet behavior for a piezoelectric inkjet printing device using a single pulse voltage pattern," *Materials Transactions*, vol. 45, (5), pp. 1794-1801, 2004.
V. Antohe and D. B. Wallace, "Acoustic phenomena in a demand mode piezoelectric ink jet printer," *J Imaging Sci Technol*, vol. 46, (5), pp. 409-414, 2002.
Wallace, "Drive waveform effects on ink-jet device performance, MicroFab technote,(1999) 3 Manning HJ, harvey RA, xaar greyscale technology," in *IS&T NIP25: International Conference on Digital Printing Technology*, 1999.
Cibis and K. Krüger, "Influencing parameters in droplet formation for DoD printing of conductive inks," in *Proc. of the 4th Int. Conf. of Ceramic Interconnect and Ceramic Microsyst. Technol.*, Munich, Germany, 2008.
H. Dong, W. W. Carr and J. F. Morris, "Visualization of drop-on-demand inkjet: Drop formation and deposition," *Rev. Sci. Instrum.*, vol. 77, (8), pp. 085101, 2006.
P. Shin and J. Sung, "The effect of driving waveforms on droplet formation in a piezoelectric inkjet nozzle," in *Electronics Packaging Technology Conference, 2009. EPTC'09. 11th*, 2009, pp. 158-162.
Y. Kim et al, "The effects of driving waveform of piezoelectric industrial inkjet head for fine patterns," in *Nano/Micro Engineered and Molecular Systems, 2006. NEMS'06. 1st IEEE International Conference On*, 2006, pp. 826-831.
H. Wu and H. Lin, "Effects of actuating pressure waveforms on the droplet behavior in a piezoelectric inkjet," *Materials Transactions*, vol. 51, (12), pp. 2269-2276, 2010.
J. C. Miers and W. Zhou, "Droplet formation at megahertz frequency," *AIChE J.*, vol. 63, (6), pp. 2367-2377, 2017.
J. Eggers, "Nonlinear dynamics and breakup of free-surface flows," *Reviews of Modern Physics*, vol. 69, (3), pp. 865, 1997.
J. R. Castrejon-Pita et al, "Plethora of transitions during breakup of liquid filaments," *Proc. Natl. Acad. Sci. U. S. A.*, vol. 112, (15), pp. 4582-4587, Apr. 14, 2015.
H. Gerhauser et al, "The effect of pulse shape on the drop volume and the frequency response of drop-on-demand ink jet transducers," in *SID Dig*, 1983, pp. 110-111.
D. B. Bogy and F. Talke, "Experimental and theoretical study of wave propagation phenomena in drop-on-demand ink jet devices," *IBM Journal of Research and Development*, vol. 28, (3), pp. 314-321, 1984.
Y. Liu et al, "Investigation of driving waveform and resonance pressure in piezoelectric inkjet printing," *Applied Physics A*, vol. 109, (2), pp. 323-329, 2012.
X. Yan, *Drop-on-Demand Inkjet Drop Formation of Dilute Polymer Solutions*. Georgia Institute of Technology, 2010.
A. Castrejón-Pita, J. Castrejon-Pita and I. Hutchings, "Breakup of liquid filaments," *Phys. Rev. Lett.*, vol. 108, (7), pp. 074506, 2012.
Bransky et al, "A microfluidic droplet generator based on a piezoelectric actuator," *Lab on a Chip*, vol. 9, (4), pp. 516-520, 2009.
Perçin and B. T. Khuri-Yakub, "Piezoelectric droplet ejector for ink-jet printing of fluids and solid particles," *Rev. Sci. Instrum.*, vol. 74, (2), pp. 1120-1127, 2003.
A. Goghari and S. Chandra, "Producing droplets smaller than the nozzle diameter by using a pneumatic drop-on-demand droplet generator," *Exp. Fluids*, vol. 44, (1), pp. 105-114, 2008.
J. Castrejón-Pita et al, "Experiments and Lagrangian simulations on the formation of droplets in drop-on-demand mode," *Physical Review E*, vol. 83, (3), pp. 036306, 2011.
D. M. Harris, T. Liu and J. W. Bush, "A low-cost, precise piezoelectric droplet-on-demand generator," *Exp. Fluids*, vol. 56, (4), pp. 83, 2015.
J. Tai et al, "Control of droplet formation in inkjet printing using ohnesorge number category: Materials and processes," in *Electronics Packaging Technology Conference, 2008. EPTC 2008. 10th*, 2008, pp. 761-766.
N. Cheng, "Formula for the viscosity of a glycerol—water mixture," *Ind Eng Chem Res*, vol. 47, (9), pp. 3285-3288, 2008.
John C. Miers and Wenchao Zhou. "Droplet formation at megahertz frequency." *AIChE Journal* 63.6 (2017): 2367-2377.

* cited by examiner

HIGH-FREQUENCY MULTI-PULSE INKJET

RELATED APPLICATIONS

This application claims priority to U.S. Provisional Application Ser. No. 62/663,710 filed on Apr. 27, 2018, which is hereby incorporated in its entirety.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

BACKGROUND OF THE INVENTION

Inkjet is a digital material dispensing technique that can deposit inks in the form of droplets at desired locations using an array of nozzles. Its application ranges from 2D printing (e.g., books, photos, magazines, advertisement, packaging, etc.), printed electronics (e.g., OLED display, circuits, sensors, etc.), and 3D printing (e.g., Stratasys Connex 3D printer). The total sales of inkjet printers reached $57 billion in 2015 and are growing at an average annual growth rate of 12.7%.

Despite its advantages (e.g., digital control, high resolution, naturally support multi-color/multi-material) and the versatile applications of inkjet, one major barrier for inkjet to increase its adoption is its printing speed, which is relatively slow compared to other printing techniques, such as laser printer and non-digital printers (e.g., gravure and screen printing) for 2D printing. The inkjet 3D printing speed is also too slow compared to traditional manufacturing techniques (e.g., injection molding).

While HP and other major inkjet suppliers (e.g., Cannon, Epson, XAAR, Kyocera, MEMJET, Konica Minolta, etc.) have been racing to improve inkjet printing speed (i.e., produce droplets in total volume per unit time), there is a fundamental limitation in fluid dynamics on how fast a droplet can be produced from a given nozzle size. There are three different ways to increase the inkjet printing speed:

1. Increase droplet size;
2. Increase printing frequency (i.e., the number of droplets generated per second per nozzle);
3. Increase the number of nozzles.

The droplet size in current inkjet printers is usually commensurate with the size of the nozzle opening. Increasing the droplet size often lead to the decrease of the printing resolution (e.g., a printer with a 600 DPI resolution needs a droplet size of ~50 um) and nozzle density (i.e., fewer nozzles can be packed into the printhead due to the larger nozzle size). The printing frequency has a fundamental limit for a given nozzle size (usually around ~10 kHz for a 50 um nozzle size, which is common in most of the current inkjet printers). Increasing the number of nozzles is what many inkjet suppliers are doing. HP has demonstrated packing over ~10,000 nozzles into a single printhead, which is approaching a limit.

An important part of this technology is generating droplets. Generally, from the point of view of droplet generation periodicity, there are mainly two different techniques widely utilized in the inkjet printing industry: continuous inkjet and drop-on-demand (DOD) inkjet. In continuous inkjet printing, a high-pressure pump controls the ink flowing from a reservoir to the nozzle to produce a continuous fluid stream of approximately the diameter of the nozzle, which breaks into droplets after leaving the nozzle. Its ejection speed is relatively high which allows a long distance between nozzle and substrate, but a complicated control system is needed. On the other hand, DOD inkjet, which creates droplets only when an actuation pulse is provided, requires a short distance which is caused by its relatively low ejection velocity. However, due to its easy operation and accurate control of droplet generation, DOD inkjet printing has become the mainstream inkjet technology.

Generally, the two most widely used DOD jetting techniques by commercial inkjet printers are thermal inkjet and piezo inkjet. The common denominator of these two techniques is to generate a pressure pulse required for the drop formation from a nozzle. In thermal inkjet, electrical pulses are applied to heating elements to produce bubbles that create pressure pulse to eject droplets. However, the high heating temperature restricts its application to biological and other heat sensitive materials. Piezo inkjet, on the other hand, uses a piezoelectrical unit to convert an electrical voltage into a mechanical deformation, which generates the required pressure to eject droplets and doesn't depend on the chemistry of the ink.

A schematic diagram of DOD piezo inkjet printing is shown in FIG. 1. As shown, driving signal 100 is sent to the driver 110, which will result in the deformation of the piezo transducer 120. When the piezo contracts (piezo moves up), a negative pressure is created inside the chamber 130, fluid will flow from reservoir 132 through channel 135 to the chamber 130. When the piezo expands (piezo moves down), it generates a high positive pressure inside the chamber 130, which will propagate from the piezo to the nozzle 140 and push the ink out of the nozzle to form a droplet 160.

In the piezo DOD inkjet process, the droplet is squeezed out under a higher pressure in the chamber which is due to the deformation of the chamber walls caused by the voltage applied to the piezoelectric transducer. The applied voltage is controlled by the driving signal/waveform. FIG. 2 is an example of a double-pulse trapezoid waveform 200 used in piezoelectric DOD inkjet. Each pulse has three parts: rising (Trising, or Tr), dwell (Tdwell or Td) and falling (Tfalling or Tf). Between two consecutive pulses, there is a waiting time (Twait or Tw), after which the next pulse will be actuated. The height of the pulse is named as the amplitude, which indicates the max voltage of the pulse. As shown in FIG. 2, the first pulse has the amplitude of V1 and the second is V2.

From the perspective of the manufacturing speed, DOD inkjet has relatively high printing speed (the total volume of droplets ejected per second per printhead) among other Additive Manufacturing methods. However, its printing speed is still relatively slow when compared with traditional manufacturing methods. For example, existing industrial inkjet printheads (e.g., Sapphire QS-256/10 AAA from FUJIFILM) typically print at a build rate of ~500 cm3/hour while the comparable-size injection molding machine typically has a build rate over 15,000 cm3/hour. Significant efforts have been reported to improve the inkjet printing speed by increasing the number of nozzles (N), droplet size (D), or the inkjet printing frequency (f, defined as the number of droplets ejected per second per nozzle). MEMJET company had successfully developed a full-width printhead with over 70,000 nozzles. But the number of nozzles is constrained by the size of the print head. Because the droplet size is usually around the same size as the nozzle, larger nozzles are needed to produce larger droplets. As a result, fewer nozzles can be included per unit area in the printhead. Furthermore, the desired printing resolution restricts the nozzle size. For instance, to achieve a 600 DPI (dot per inch) resolution, the droplet diameter needs to be smaller than ~50 um. For the printing frequency, the commercial inkjet printer typically prints at the frequency of ~10 s kHz. This is because the droplet generation in current inkjet printers is primarily driven by the surface tension of the ink, which limits the droplet generation frequency to ~10 s kHz for a ~50 μm sized droplet. The capillary time (action time of surface tension) is defined as:

$$T_\sigma = \sqrt{\frac{(\rho D^3)}{\sigma}} \quad (1)$$

where σ is the surface tension of the ink, ρ is the density of the liquid, D is the nozzle diameter. The capillary time dictates the maximum droplet formation frequency (the reciprocal of the capillary time), which decreases as the nozzle diameter increases. Therefore, a smaller nozzle is needed for a higher frequency, which typically leads to smaller droplet size and does not improve the overall printing speed. All these methods are summarized in FIG. 3.

BRIEF SUMMARY OF THE INVENTION

According to the above discussion, none of the methods can essentially increase the printing speed because they either improve the droplet ejection frequency but sacrifice the droplet volume or improve the droplet size but lose the resolution and ejection frequency. To overcome these noted deficiencies, embodiments of the present invention provide new approaches to increase the printing frequency without reducing the droplet size by applying a multi-pulse driving signal to a small nozzle, which would allow a significant increase in printing speed. The small nozzle enables higher ejection frequency and number of nozzles installed in the printhead while the multi-pulse signal can generate a droplet much bigger than the nozzle size, as illustrated in FIG. 4.

In another embodiment, the present invention provides a method, system, approach and solution that increases the inkjet printing speed by using a smaller nozzle to produce the same-size droplet using a multi-pulse driving signal, which allows for higher printing frequency due to the smaller nozzle size as dictated by the fundamental droplet formation dynamics.

In another embodiment, the present invention provides a method, system, approach and solution that significantly increases the printing speed of inkjet by generating a multi-pulse driving signal for the printhead that can improve the printing speed significantly beyond the theoretical limit.

In another embodiment, the present invention provides a method, system, approach and solution that increase the printing speed of the piezoelectric inkjet printheads thereby attaining the following benefits: 1. It can increase the printing frequency to allow each nozzle to produce more droplets per second without sacrificing the printing resolution. 2. It can allow more nozzles to be packed into the printhead and thus increase the overall printing speed of the printhead. 3. This technology can be readily used in existing piezoelectric inkjet printheads, which reduces the cost of adoption.

In another embodiment, the present invention provides a method, system, approach and solution that uses a smaller nozzle size that allows for higher nozzle density (i.e., packing more nozzles into the printhead).

In another embodiment, the present invention provides a method, system, approach and solution that significantly increases the printing speed of inkjet by increasing the printing frequency to beyond the theoretical limit for the desired droplet size, which allows for a significant cost reduction for using inkjet across all of its applications, from 2D printing, to printed electronics, to 3D printing.

In another embodiment, the present invention provides a method, system, approach and solution that for a piezoelectric inkjet, changes the driving signal of the printhead based on the droplet formation dynamics, thereby increasing the printing frequency and thus the printing speed by ~10 times.

2D printing: inkjet is a common tool to print text and images on various surfaces (e.g., paper, ceramic tiles, packaging box, etc.). Just for printing on paper, currently, 46 trillion pages are printed annually (~$640 Billion global market) by both non-digital and digital printing methods. The biggest challenge for inkjet to compete with other printing methods is the printing speed. The increase of inkjet printing speed by ~10 times will allow inkjet almost to dominate the 2D printing market due to the increased productivity and other advantages inkjet has (e.g., multi-color, digital, etc.).

Printed electronics: inkjet is used as a major tool in printed electronics (which is a fast-growing multi-billion dollar market) and one main disadvantage against other printing methods, such as screen printing, is the printing speed. The increase of inkjet printing speed by ~10 times will allow inkjet to significantly expand its market share.

3D printing: inkjet 3D printers have significant advantages over other 3D printing methods, such as high resolution and the natural support of multiple materials. The increase of inkjet printing speed by ~10 times will significantly reduce the manufacturing cost and make it possible to be adopted for medium to large volume production.

In another embodiment, the present invention provides a method, system, approach and solution that can be applied to other signals, including but not limited to square signal, bipolar trapezoid signal, etc.

In another embodiment, the present invention provides a method, system, approach and solution that can be applied to other inkjet operating models, like the pull-push model.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

In one embodiment, the present invention is based on a finding that the printing frequency is limited by the nozzle size and an approximate theoretical limit $$f = \sqrt{\frac{\sigma}{\rho D^3}} \tag{1}$$

where f is the printing frequency (i.e., the number of droplets that can be generated per second per nozzle), σ is the surface tension of the ink, ρ is the density of the ink, D is the diameter of the nozzle. The reason why this limit exists is the droplet breakup is driven by the surface tension of the ink, which can only act this fast at the length scale of the nozzle. Usually, the larger the force, the faster it acts at a given length scale. While it is possible to introduce other possible forces to break up the droplet, the surface tension is the main driving force for the breakup of the droplet in many inkjet printers. Because the surface tension of the ink cannot be increased much and the density of the ink usually cannot be decreased much, the only practical way to increase printing frequency is to reduce nozzle size. At the maximum printing frequency, the droplet size is usually similar to the nozzle size. Therefore, the reduction of the nozzle size only decreases the printing speed (i.e., the total volume of the ejected droplets).

In a preferred embodiment, the present invention uses a multi-pulse driving signal to eject droplets that are much larger than the nozzle size at high frequency beyond the theoretical limit for the desired droplet size, which allows the use of a smaller nozzle than the desired droplet size. Because printing speed is approximately $d^3 \times N \times f$, where d is the droplet diameter, N is the number of nozzles in the printhead, f is the printing frequency. Using a smaller nozzle will allow higher printing frequency based on Equation (1) and also larger N for a given size of the printhead. This approach allows the printing speed to be improved by increasing all of the three factors of printing speed.

Figure 1:
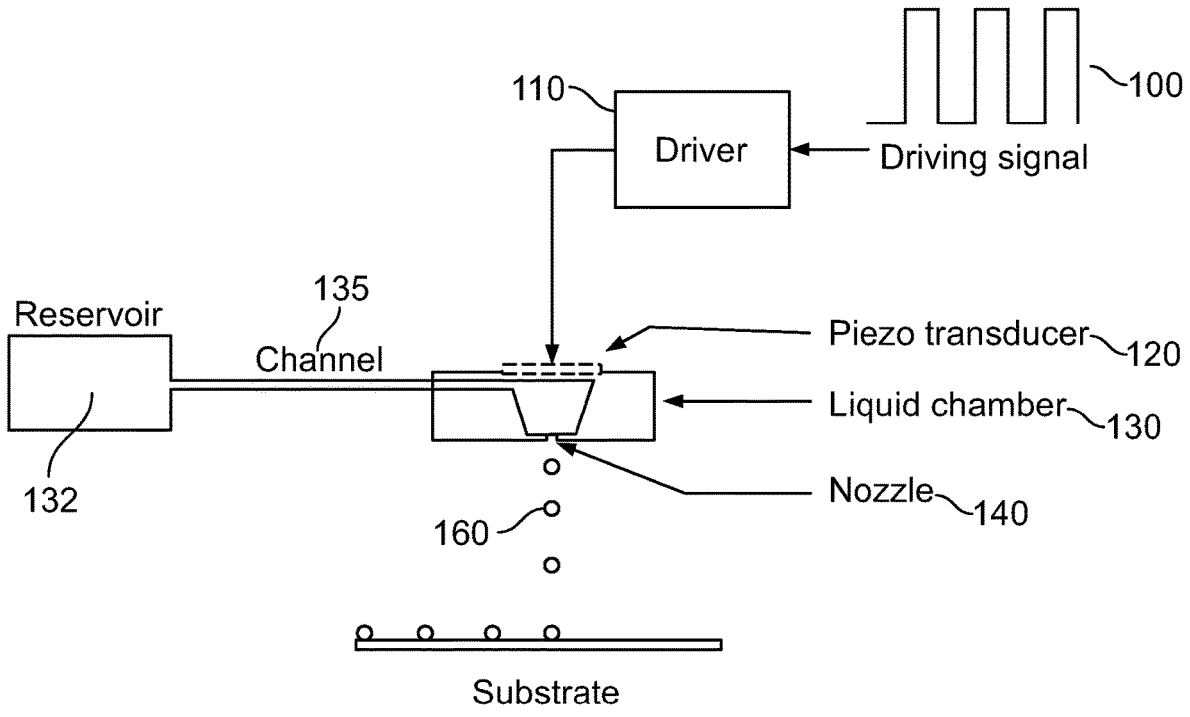
FIG. 1 is a schematic diagram of DOD piezo inkjet printing.
Figure 5:
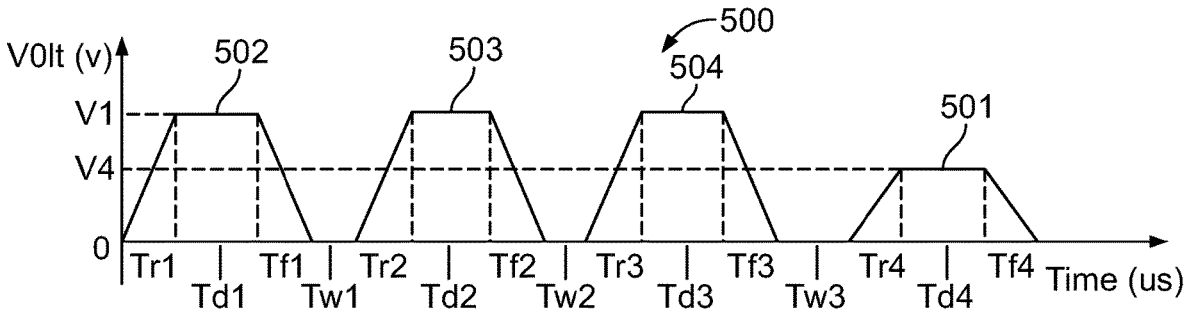
FIG. 5 illustrates a four-pulse trapezoid signal example for an embodiment of the present invention.

In a preferred embodiment, as shown in FIG. 5, a four-pulse trapezoid signal or wave form 500 may be used in connection with an inkjet device in a manner illustrated in FIG. 1. As shown, waveform 500 includes multiple trapezoids 501-504 with trapezoid 501 having an amplitude less than the others. In this embodiment of the present invention, the multi-pulse signal or waveform 500 maximizes the ink volume that flows out the nozzle in the shortest time while keeping the ejected filament attaching to the ink inside the nozzle until the last pulse for generating large droplet at high frequency is provided. Table 1 provides unique characteristics of the signals that may be used with the various embodiments of the present invention.

TABLE 1

Unique characteristics of the driving signal

| Characteristics | Value | Working Principle |
|---|---|---|
| Tr, Tf | 1/3*T | Least time used to arrive at the expected position |
| Td | As eq (6) | Max volume ink flows out while filament not breakup |
| Tw | $\frac{2 * L_n}{c}$ | Refill the chamber and provide enough ink to be ejected |
| $Tw_{n-1}$ | $\frac{4 * L_b}{c}$ | Quickly dampen out the residual vibration to increase frequency |
| $A_{n-1}$ | $A_n(1-\delta)^4$ | Quickly dampen out the residual vibration to increase frequency |

Design of the Inkjet Printhead

Figure 12A:
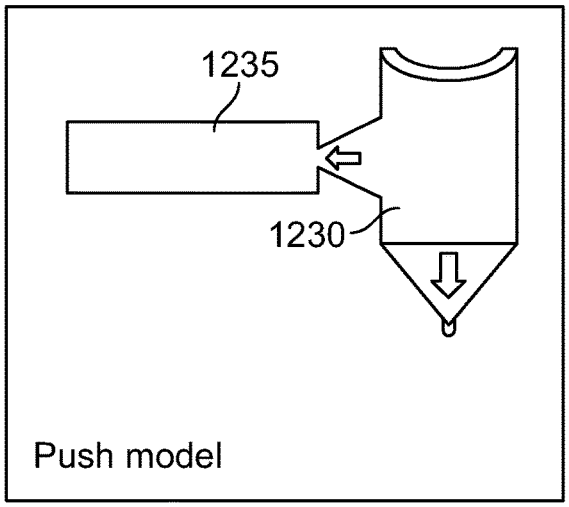
FIG. 12A shows a push model for channel structure for an embodiment of the present invention.
Figure 12B:
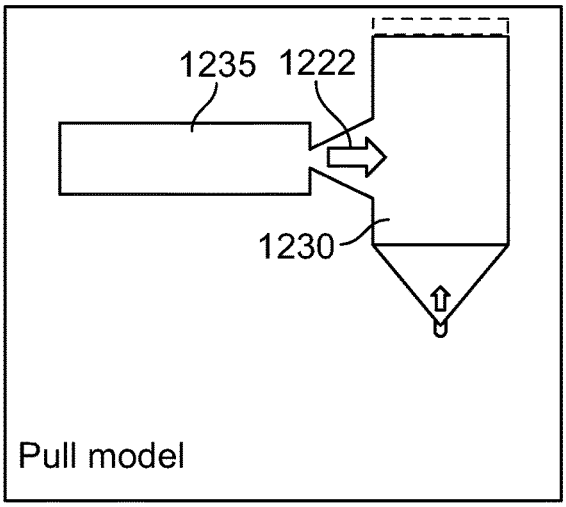
FIG. 12B shows a pull model for channel structure for an embodiment of the present invention.

To increase the printing speed, two categories of functions of the signal are defined: 1. Increasing the ejected ink volume, i.e., more ink flows out of nozzle and 2. Increasing the ejection frequency, i.e., less time used in the process. In other embodiments, the following criteria are used by the present invention: a piezo with higher resonant frequency is preferred; the ink channel 135 may have the same length as the chamber 130; as shown in FIG. 12 ink channel 1235 may be designed asymmetrically such that it is easier for the ink to flow into the ink chamber 1230 and more difficult for the ink to flow back to reservoir.

Tr (Rising Time)

Figure 6A:
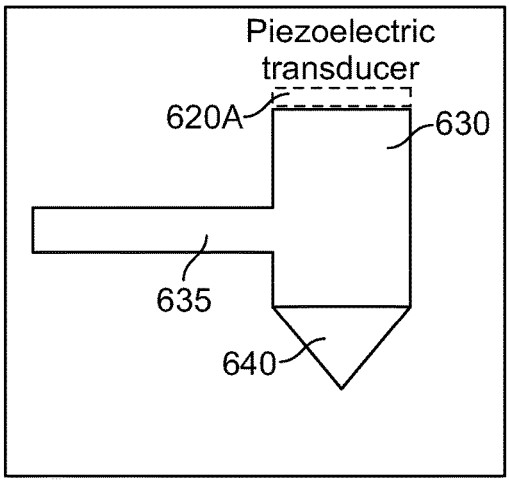
FIG. 6A illustrates the status of an embodiment of the present invention at equilibrium.
Figure 6B:
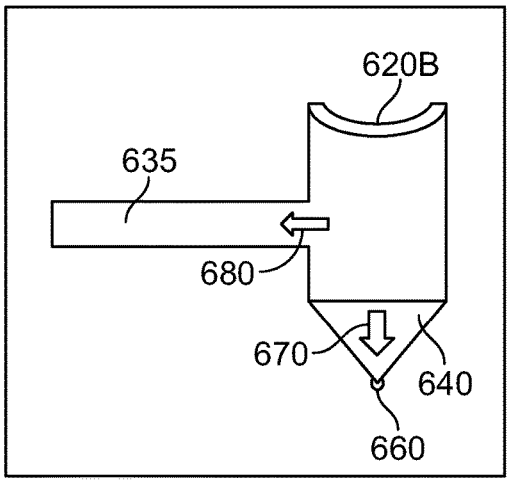
FIG. 6B illustrates fluid flow where the arrow represents flow direction for the embodiment shown in FIG. 6A after piezo deformation.

In FIG. 6, arrows 670 and 680 represent ink flow direction. Initially, the system is in the equilibrium status, where no voltage is applied, and there is no deformation piezo 620A and no fluid flows. Then a signal (the first pulse) is applied to the piezo, where the voltage increased from 0 volts to V1. Then piezo 620B expands (moving from the equilibrium status down to the expected position) and create a high pressure inside chamber 630, which pushes the ink 660 out of nozzle 640 (see arrow 670) and back into channel (see arrow 680).

To arrive at the expected displacement, the less time the piezo takes, the higher the printing speed can be achieved. Hence, an object of the present invention is to find the minimum value of Tr. If greater value is used in the signal than this minimum value, it would take longer time for the ejection process, which would decrease the printing speed; on the contrary, if smaller value is used than that of the min value, the piezo would not arrive at the expected position after the rising time, which would disturb the ejection process. In addition, the generated pressure due to piezo expansion is proportional to the voltage change rate, i.e., $$|\Delta P| \propto \frac{\Delta V}{Tr} \tag{2}$$

Hence, with the same voltage magnitude change, the smaller the Tr is, the higher the pressure will be, the higher ejection velocity it can achieve, the higher volume flow rate, and the printing speed it would be. It is found that it takes around ⅓ of the reciprocal of the resonant frequency of the piezo to arrive at the expected position. This is the least time the piezo needs, which defines the value of the Tr:

$$Tr \approx \frac{1}{3} * \frac{1}{f} \tag{3}$$

Where f is the resonant frequency of the piezo. Since equation (3) uses the property of the piezo, it should be applied to all the pulses, $$Tr = Tr1 = Tr2 \ldots = Trn \tag{4}$$

This defines the Tr1 and Tr2 in equation (6).

Td (Dwell Time)

Figure 2:
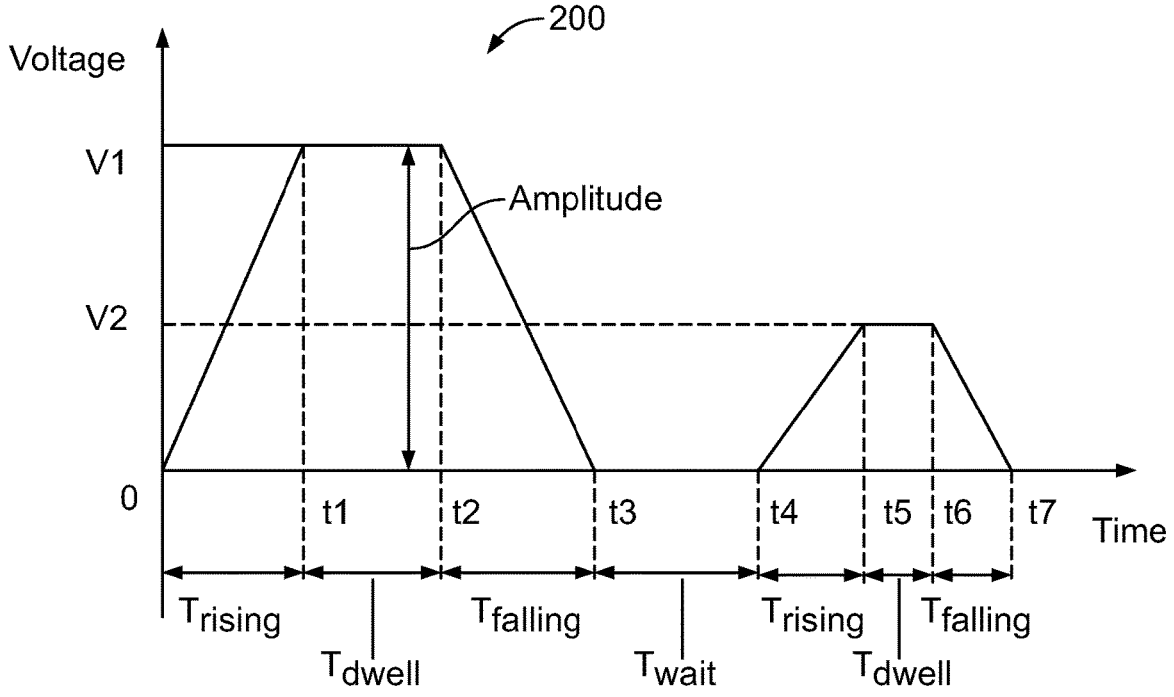
FIG. 2 shows a double-pulse signal used in inkjet DOD ejection.
Figure 3:
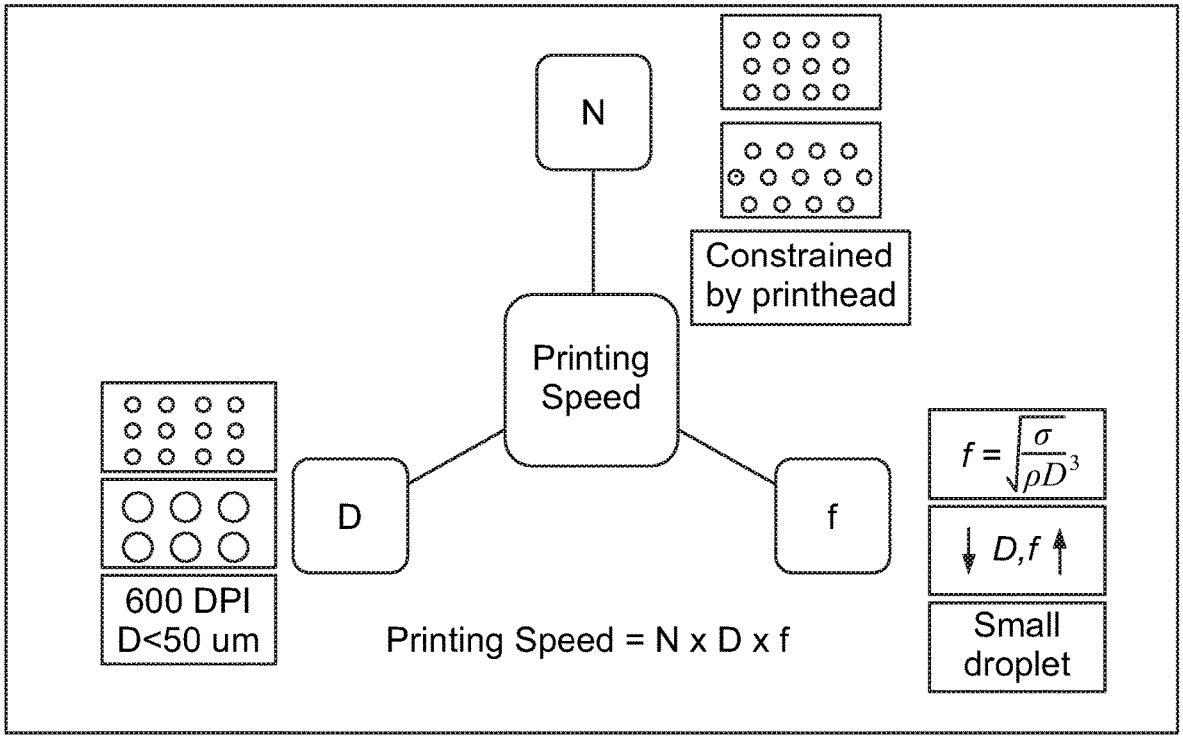
FIG. 3 shows previous methods of improving the inkjet printing speed and their limitations.
Figure 4:
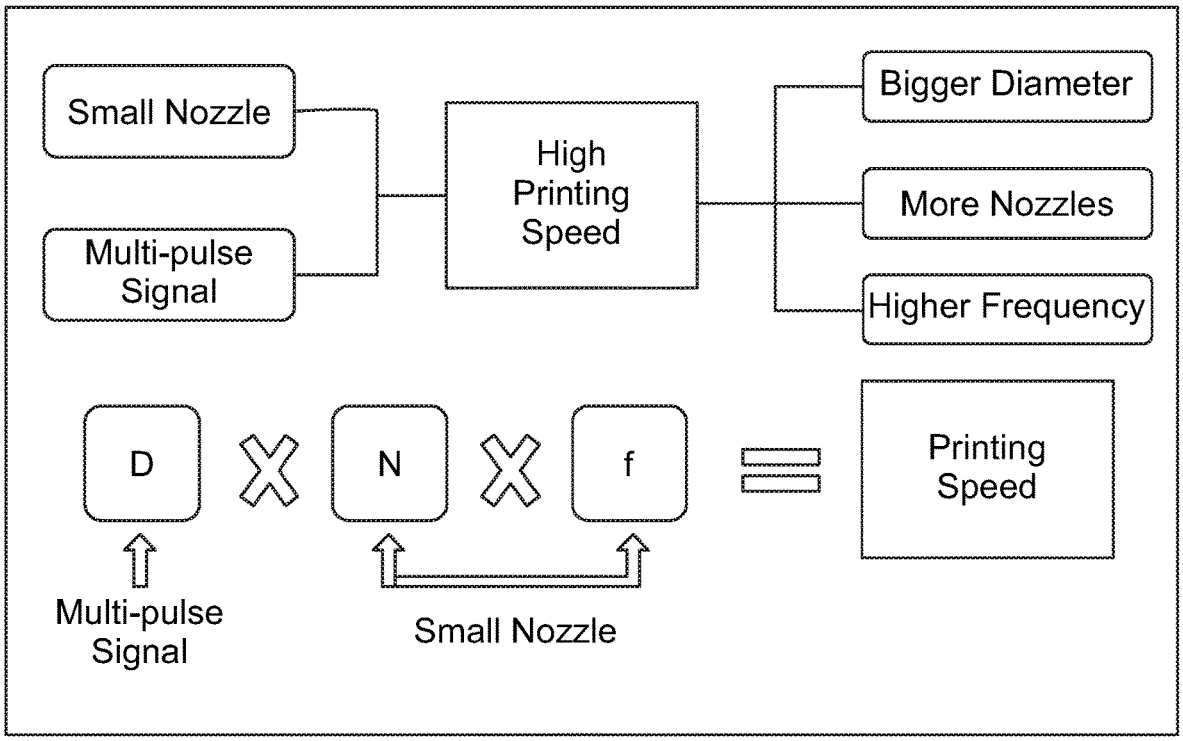
FIG. 4 shows current methods of improving inkjet printing speed for various embodiments of the present invention.

During this period (see FIG. 2), piezo 620A stays in the same position and ink initiated in Tr period keeps flowing out of nozzle due to inertia. It needs some time to allow enough ink to flow out of nozzle. Otherwise, the next pulling signal would suck all the ink back into the nozzle and it would fail to eject. However, if Td were too long, filament breakup from the nozzle would occur in the Td period or in the next pulling signal period. This would not generate one big droplet using a multi-pulse signal. Therefore, a proper value is required here to have max ink out of nozzle with relatively short time.

For the pressure on the nozzle exit, after its peak, it starts to decrease, which induces the decrease of the ejection velocity on the nozzle exit. Therefore, a velocity difference between the ejected filament head and the nozzle exit occurs, which results in the filament diameter decreasing near the nozzle exit, i.e. stretching. Hence, after the peak, the total ink volume flows out of nozzle increases but the outflow rate decreases due to the decreases of velocity and the filament diameter, as explained in FIG. 7.

To have max volume of ink out of nozzle 640, Td should be longer. However, when the next pushing signal (Tr2) comes to the nozzle exit, the filament should not pinch-off, otherwise it would generate separated small droplets.

Therefore, the period, starting with stretching in Tr1 and ending with the next peak pressure generated in Tr2 arrived at the nozzle exit, should be less than the pinch-off period, i.e.

$$0.5Tr1 + Td1 + Tf1 + Tw + 0.5Tr2 + Tp < T_\sigma \tag{5}$$

here Tr1, Td1 and Tf1 is the rising, dwell and falling time of the first pulse, Tr2 is the rising time of the second pulse, Tw is the waiting time between two consecutive pulses, Tp is the acoustic pressure propagation time, i.e., the time that piezo-generated pressure needs to travel from piezo to nozzle exit, which is $L_b/c$, $L_b$ is the distance from piezo to nozzle exit and c is the acoustic wave propagation speed inside the chamber ink. The coefficient of 0.5 is used in the rising time because the peak of the pressure induced during the rising time occurs around half of the Tr. After rearranging, equation (6) is:

$$0 < Td1 < T_\sigma - Tp - 0.5(Tr1 + Tr2) - Tw - Tf1 \tag{6}$$

Figure 7:
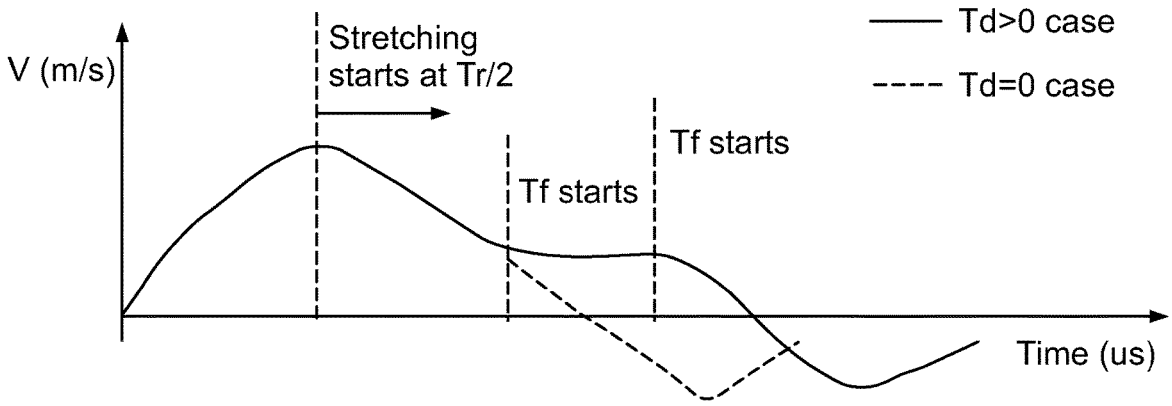
FIG. 7 shows how velocity on the nozzle exit changes with time for two different Td values for an embodiment of the present invention.

As indicated in FIG. 7, the velocity and the filament diameter in the nozzle exit starts decrease after Tr/2. As time goes on, these two values will be smaller and smaller. After the beginning of the Tf period (pulling back period, which will be introduced in the next section), these two values will decrease with a faster speed. Hence the majority of the ink is ejected in Tr and Td periods. Till now, all the parameters in equation (6), except Tw and Tf1, are defined. Below these two periods will be defined, where the main function is refilling the chamber and be ready for the next ejection.

Tf (Falling Time)

Figure 8A:
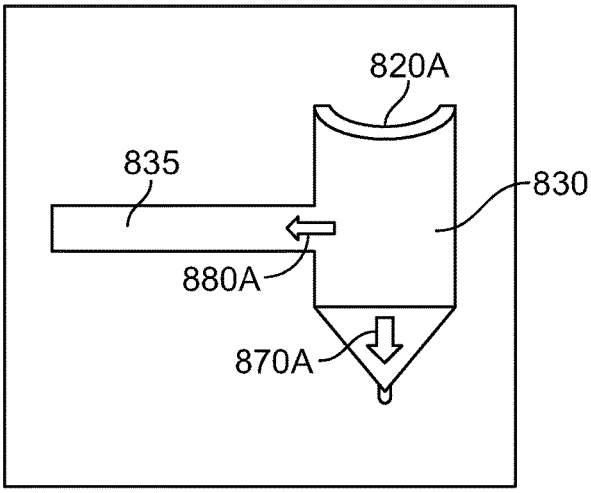
FIG. 8A illustrates the piezo traveling from the bottom back to equilibrium for an embodiment of the present invention.
Figure 8B:
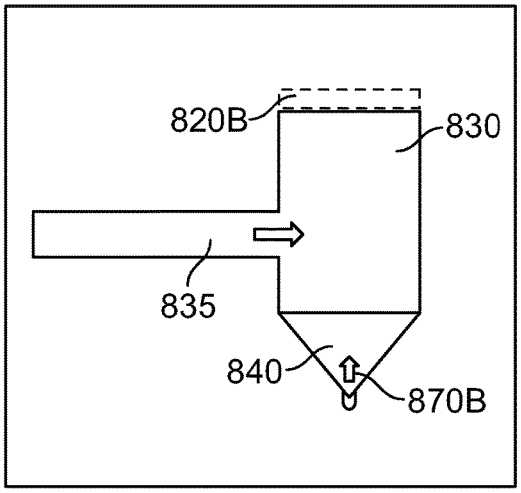
FIG. 8B illustrates fluid flow (see arrows) for the embodiment shown in FIG. 8A after reaching equilibrium.

In this period as shown in FIGS. 8A and 8B, piezo 820A will move from the bottom back to a position where piezo 820B is an original equilibrium position, which is the opposite process of the Tr period. In this period, a negative pressure will be created in the chamber 830, which slows downward flow of ink (arrow 870A) and even reverses the ink flow direction (arrow 870B), i.e. ink flows back to chamber 830 from channel 835 and nozzle area 840 (arrow 880A). This has a negative effect on the ejected volume: it reduces the filament velocity and the filament diameter on the nozzle exit. Therefore, this period is desired to be shorter. At the same time, smaller Tf value will induce a higher negative pressure, as described in equation (2). However, as we mentioned before, the ejection velocity and filament diameter are much smaller at this period, which indicates that the ink volume sucked back due to this relatively high negative pressure will be negligibly small compared to the ink ejected out of nozzle. Hence the majority of the ink that refills the chamber comes from the reservoir through channel, which is driven by the asymmetric acceleration of the acoustic pressure waves.

The shortest time for this period is also determined by the piezo property, like defined in Tr, which is around ⅓ of the reciprocal of the piezo resonant frequency. This value is corresponding to the value of Tf1 in equation (6).

Tw (Waiting Time)

Figure 9:
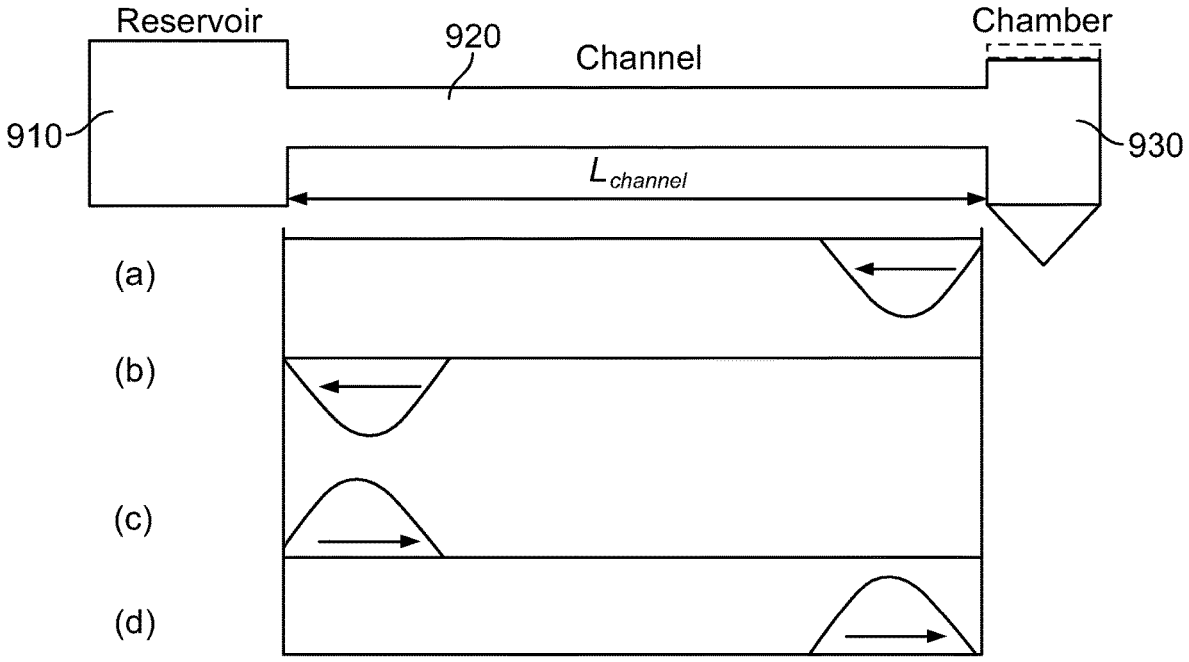
FIG. 9 shows an acoustic pressure wave propagation and reflection between the chamber and reservoir for an embodiment of the present invention.

In this period, the piezo stays in the equilibrium position and waits for the next driving pulse. As shown in FIG. 9, most of the refilled ink for chamber 930 comes from reservoir 910, the acoustic wave in channel 920 is analyzed. FIG. 9(*a*) shows that a negative pressure caused by piezo moving up in Tf period propagates towards the reservoir, which takes $L_n/c$ time to drive the ink to flow from reservoir to the chamber. FIGS. 9 (*b*) and (*c*) show that the pressure arrives at reservoir and is reflected, where the acoustic pressure becomes positive and starts to propagate toward the chamber. FIG. 9 (*d*) shows that after another $L_n/c$ time, this positive pressure propagates into the chamber. At this time instance, if the next push Tr2 is applied, then this reflected positive pressure would be reinforced and generate a bigger push with faster ejection velocity to catch up with the previous ejected filament head. Therefore, the waiting time is determined as:

$$Tw = \frac{2 * L_n}{c} \tag{7}$$

Where $L_n$ is the length of the channel, and c is the acoustic wave propagation speed inside the channel ink. This is corresponding to Tw in equation (6).

Note the above description is applied to a simple syringe or reservoir ink supply system. If a sophisticated ink supply system where ink can be circulated through the printhead continuously, then Tw can be assumed to be zero since the circulation system can refill the chamber all the time.

The parameters in the equation (6) are defined and summarized in Table 2. The calculations are approximations and do not mean to be exact.

TABLE 2

| Parameters | Expressions |
|---|---|
| Tp | $T_p = \frac{L_b}{c}$ |
| Tr | $Tr = Tr1 = Tr2 -= Tm = \frac{1}{3} * \frac{1}{f}$ |
| Tw | $Tw = \frac{2 * L_n}{c}$ |
| Tf1 | $Tf1 = \frac{1}{3} * \frac{1}{f}$ |
| $T_\sigma$ | $T_\sigma = \sqrt{\frac{(\rho D^3)}{\sigma}}$ |

Tw(n−1) (the waiting time between the second-to-last and the last pulse)

For reliable jetting, a subsequent droplet should not be ejected until the meniscus vibration from the previous droplet ejection has sufficiently decayed. Therefore, the function of the last pulse is to quickly dampen the residual pressure wave inside the chamber, such that the next droplet ejection cycle can start earlier. This can increase the printing frequency and the printing speed. The last and max signal remaining in the chamber is the negative signal induced from the second-to-last pulse. To dampen this negative signal, a positive signal with a specific amplitude should be applied in a proper time.

Figure 10:
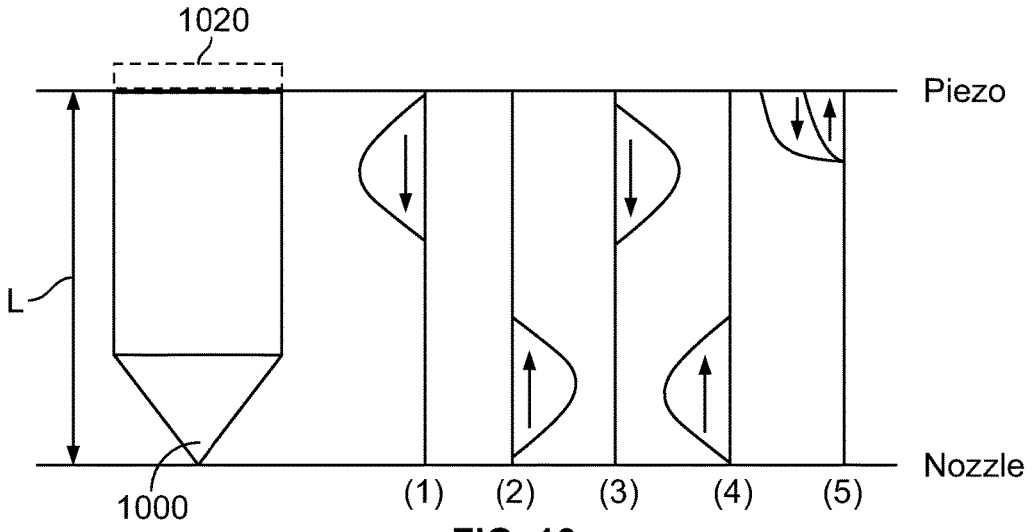
FIG. 10 provides three examples of the possible signal amplitude for use with various embodiments of the present invention.

As shown in FIG. 10, the negative signal from the second-to-last pulse (FIG. 10 (1)) would be reflected into positive first at nozzle exit 1000 (FIG. 10 (2)), then reflected again into negative (FIGS. 10 (3) and (4)) and propagate to the piezo 1020 (FIG. 10 (5)). The total traveled distance for acoustic wave is four times of the nozzle-piezo distance which is labelled "L." Therefore, to maximize the damping effect and have a less residual vibration time, the positive pulse should be applied at $$Tw3 = \frac{4 * L_b}{c} \tag{8}$$

where $L_b$ is the distance from piezo to nozzle exit and c is the acoustic wave propagation speed.

Signal Amplitude

To achieve the goal of generating one big droplet using multi-pulse signal, the general principle is liquid induced by the latter signal should have a higher ejection velocity such that it can catch up with the former ink. This requires the latter signal amplitude should not be less than the former one for a preferred embodiment of the present invention.

The first ejected filament usually has a slower overall velocity than the filament that follows. This is because the residual acoustic wave from the first pulse can be added to the pressure wave induced by the next pulse, which will generate a higher ejection velocity filament. Therefore, even when A1=A2, the ejection velocity induced by the second pulse can still be higher than the first one. Hence besides the signal shown in FIG. 5, FIG. 11 shows some of the possible amplitude relationships to achieve the above goal.

Figure 11:
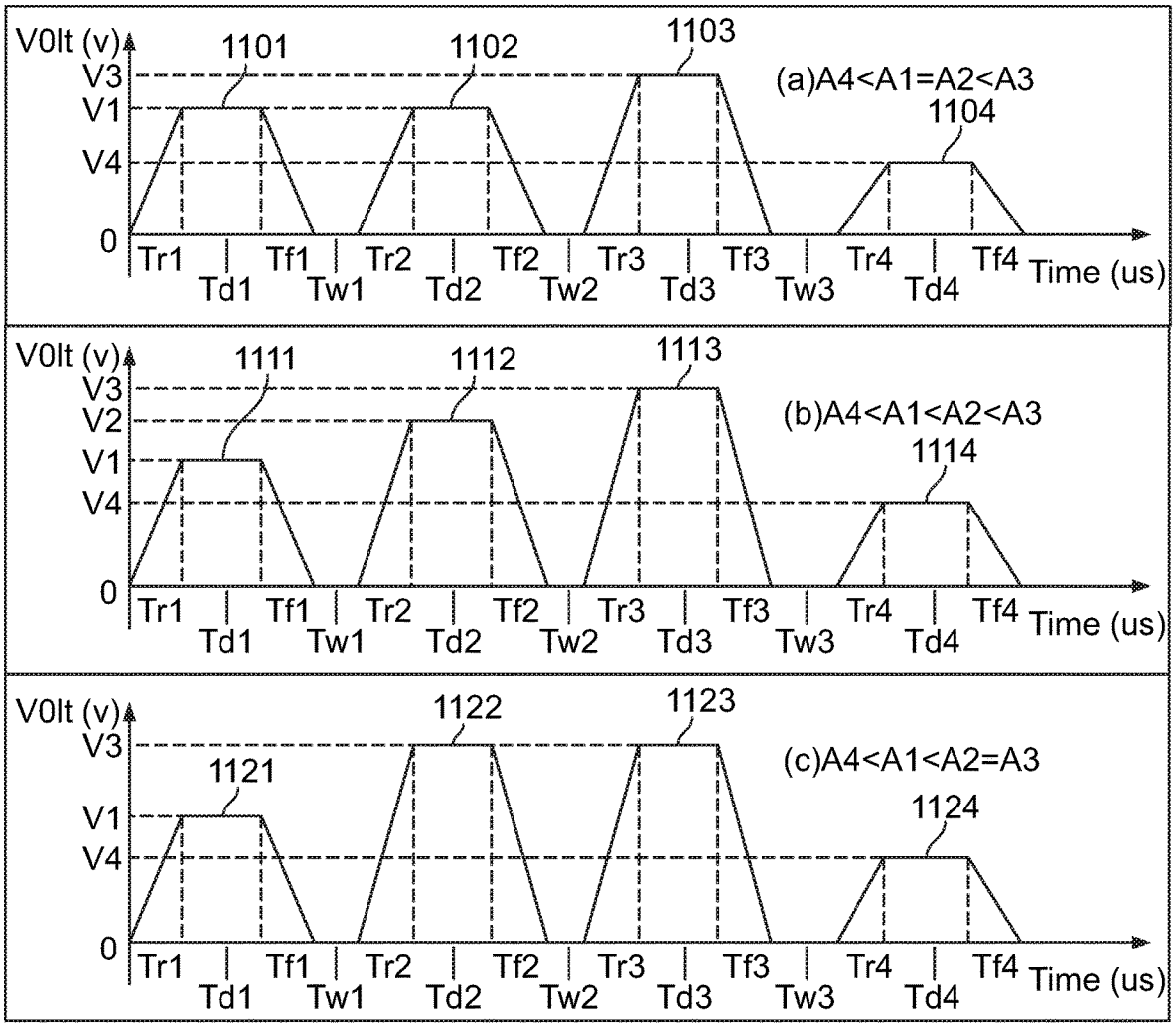
FIG. 11 provides three examples of the possible signal amplitude for use with various embodiments of the present invention.

FIG. 11 (*a*) shows the case that A4<A1=A2<A3, where the first two pulse 1101-1102 have the same voltage and while third pulse 1103 has the highest voltage and the fourth pulse 1104 has the lowest voltage. This guarantees that the third pulse induced filament has the highest velocity, catches up with the former ink and forms one big droplet. Another case (A4<A1<A2<A3) is shown in FIG. 11 (*b*), where the second pulse 1112 has higher voltage than the first one 1111 but less than the third one 1113 the fourth pulsed 1114 has the lowest. This will also generate one big drop with higher ejection velocity than the case in FIG. 11 (*a*). The voltage of the second pulse 1122 can be further increased to be the same as the third pulse 1123, as shown in FIG. 11 (*c*).

The acoustic wave dissipates with a factor of 8 during the propagation and reflection due to viscous, friction etc. To avoid over-damping the residual vibration, the actual amplitude of the last pulse should be reduced to the amplitude as below:

$$V4 = V3(1-\delta)^4 \tag{9}$$

Where V3 and V4 are the amplitude of the second-to-last pulse and the last pulse, δ is the acoustic wave dissipation factor.

Channel and Reservoir Design

Channel is the part that connects ink in reservoir and ink in chamber. There are two requirements for the channel to improve the printing speed. First, in one embodiment, the channel length may be the same as the chamber length. As shown above, there are two acoustic wave propagation and reflection directions: from piezo to nozzle and from piezo to reservoir. If the channel and the chamber had the same length, with the same ink, it takes the same time for the acoustic wave to propagate and be reflected back to the piezo. Since both the nozzle and reservoir are open end, this provides the same boundary condition for these two-acoustic waves, which indicates that the reflected waves are homogeneous, i.e. both positive or both negative. For both positive case, the next push from the piezo would be enhanced by the reflected wave from the reservoir and the nozzle, which would eject more ink out with higher ejection velocity compared to the case where only the reflection from nozzle is enhanced. This will increase the printing speed and make sure the later ink catches up with the previous ink. For both negative case, such as in Tf period, the sucking effect due to piezo pulling would be enhanced. As mentioned before, most of the ink that refills the chamber comes from reservoir. Therefore, this enhanced suction would provide a faster refill speed, i.e. less chamber refilling time, and improve the printing speed.

In another embodiment, the channel is designed so that ink can flow into the chamber easily when the piezo pulls up (moving upwards) while flow is restricted when the flow is back into the reservoir when the piezo pushes down (moving downwards). This can be achieved in several different ways. To accomplish this, the present invention in one embodiment allows ink to flow through it only in one direction, i.e. ink only flows towards the chamber 1230 from channel 1235 and never back to the reservoir. In another embodiment, a diffuser structure 1222 in channel 1235 may be used as shown in FIG. 12.

In the push model, the channel can be treated as a nozzle in the side of the chamber. Note the diameter of channel is smaller than that of the chamber, which means that more flow resistance is in the channel. Therefore, more ink flows towards the nozzle, not the channel. In addition, the conical structure of the channel increases the flow difficulty back to the reservoir, which reduces the amount of back-flowed ink further.

In the pull model, ink flows back into the chamber from the reservoir through the channel and from the nozzle. Here the diameter of the minimum part of the channel is of one order of magnitude bigger than the nozzle diameter. Hence, the flow resistance in the nozzle is much higher and ink would flow from the chamber through the channel to refill the chamber.

For the system that does not have the recirculation system, the bigger the reservoir, the less influence it would have on the ejection process.

In another preferred embodiment of the present invention where many further include a plurality of highly packed small nozzles as the printhead. To avoid the interaction of the droplets produced by neighboring nozzles, the timing for the generation of droplets between neighboring nozzles will be slightly staggered by controlling the timing of the driving signal.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above-described embodiments, methods, and examples, but by all embodiments and methods within the scope and spirit of the disclosure.

What is claimed is:

1. A printing system for forming a fluid droplet comprising:

a piezo in communication with a nozzle having an orifice:

a chamber that receives fluid from a channel, said chamber supplies fluid to said nozzle;

a controller that generates a driving signal that has a plurality of pulses and that is sent to the piezo;

said piezo deform in response to said driving signal to eject fluid in the form of a filament from said nozzle to form a droplet;

a portion of said ejected filament is attached to the fluid inside the nozzle until the last pulse is generated wherein a droplet larger in diameter than the orifice of said nozzle is create; and an acoustic wave created by said piezo that travels four times the distance between said nozzle and said piezo.

2. The printing system of claim 1 wherein said multi-pulse driving signal is a four-pulse trapezoid waveform.

3. The printing system of claim 2 wherein the fourth trapezoid has an amplitude that is less than the previous three trapezoids.

4. The printing system of claim 1 wherein one of said pulses subsequent to a first pulse has a greater amplitude than the first pulse.

5. The printing system of claim 1 wherein the second pulse creates a pressure that increases the velocity of fluid being ejected as compared to fluid ejected by said first pulse.

6. The printing system of claim 1 wherein a first section of a filament ejected by the first pulse has a slower velocity than a subsequently ejected filament by said drive pulse.

7. The printing system of claim 1 wherein the fourth pulse has an amplitude that is less than the other pulses.

8. The printing system of claim 7 wherein the amplitude of the third pulse is greater than the amplitudes of the first and second pulses.

9. The printing system of claim 7 wherein the amplitude of the third pulse is greater than the amplitude of the second pulse and the amplitude of the second pulse is greater than the amplitude of the first pulse.

10. The printing system of claim 1 wherein the waiting time between pulses is determined as:

$$Tw = \frac{2 * L_n}{c}$$

where $L_n$ is the length of said channel, and c is the acoustic wave propagation speed inside said channel.

11. The printing system of claim 1 wherein the waiting time (Tw) between the second-to-last and last pulses is determined as:

$$Tw = \frac{4 * L_b}{c}$$

where $L_b$ is the distance from piezo to nozzle exit and c is the acoustic wave propagation speed.

12. The printing system of claim 1 wherein the amplitude of the last pulse is determined as:

$$V4=V3(1-\delta)^4$$

where V3 and V4 are the amplitude of the second-to-last pulse and the last pulse, δ is the acoustic wave dissipation factor.

13. The printing system of claim 1 wherein the fluid flows in one direction.

14. The printing system of claim 13 wherein a one way valve is located between said reservoir and said chamber.

15. The printing system of claim 13 wherein a diffuser is located between said reservoir and said chamber.

16. The printing system of claim 1 wherein the length of said channel and said chamber are equal.

17. The printing system of claim 1 wherein the rising time of said piezo is around ⅓ of a reciprocal of the piezo resonant frequency.

18. The printing system of claim 1 wherein said piezo remains in the same position (dwell time) is determined as: $0<Td1<T_o-Tp-0.5(Tr1+Tr2)-Tw-Tf1$.

19. A printing system for forming a fluid droplet comprising:

a piezo in communication with a nozzle having an orifice;

a chamber that receives fluid from a channel, said chamber supplies fluid to said nozzle;

a contoller that generates a driving signal that has a plurality of pulses and that is sent to the piezo;

said piezo deforms in response to said driving signal to eject fluid in the form of a filament from said nozzle to form a droplet;

a portion of said ejected filament is attached to the fluid inside the nozzle until the last pulse is generated wherein a droplet larger in diameter than the orifice of said nozzle is created;

wherein the fourth pulse has an amplitude that is less than the other pulse; and wherein the amplitudes of the second and third pulses are equal or greater than the amplitude of the first pulse.

* * * * *